US006974905B2

(12) United States Patent
Kazama

(10) Patent No.: US 6,974,905 B2
(45) Date of Patent: Dec. 13, 2005

(54) COAXIAL CABLE AND TRANSMISSION TRANSFORMER USING SAME

(75) Inventor: Osamu Kazama, Tomioka (JP)

(73) Assignee: Nihon Kohden Corporation, Tokyo (JP)

( * ) Notice: Subject to any disclaimer, the term of this patent is extended or adjusted under 35 U.S.C. 154(b) by 0 days.

(21) Appl. No.: 10/740,404

(22) Filed: Dec. 22, 2003

(65) Prior Publication Data

US 2004/0129446 A1 Jul. 8, 2004

(30) Foreign Application Priority Data

Dec. 24, 2002 (JP) ..... P2002-372876

(51) Int. Cl.[7] ..... H01B 7/00
(52) U.S. Cl. ..... 174/28; 333/12
(58) Field of Search ..... 174/28, 102 R, 174/108, 110 R, 113 R, 120 R, 120 AR, 120 SR; 333/12

(56) References Cited

U.S. PATENT DOCUMENTS 3,287,489 A * 11/1966 Hvizd, Jr. ..... 174/102 SC
4,149,170 A * 4/1979 Campbell et al. ..... 343/885
4,173,742 A * 11/1979 Lehmann ..... 333/100
4,371,742 A * 2/1983 Manly ..... 174/36
4,631,504 A * 12/1986 Matsuda et al. ..... 333/25
4,839,531 A * 6/1989 Stemmons et al. ..... 307/17
4,922,204 A * 5/1990 Duerr et al. ..... 324/322
5,091,707 A * 2/1992 Wollmerschauser et al. .. 333/12
5,117,145 A * 5/1992 Furukawa ..... 310/313 R
5,393,929 A * 2/1995 Yagihashi ..... 174/36
5,521,358 A * 5/1996 Eilentropp ..... 219/549
6,337,443 B1 * 1/2002 Dlugas et al. ..... 174/120 R
6,477,767 B1 * 11/2002 Zhao ..... 29/828
6,756,538 B1 * 6/2004 Murga-Gonzalez et al. .. 174/28

FOREIGN PATENT DOCUMENTS

DE 1 763 364 * 1/1972 ..... H02G/13/16
JP 57-44826 A * 3/1982 ..... G01K/7/38
JP 63-140609 U 9/1988
JP 03-114108 A * 5/1991 ..... H01B/11/18
JP 6-203664 A 7/1994
JP 2001-357730 A * 7/2001 ..... H01B/9/00

* cited by examiner

*Primary Examiner*—William H. Mayo, III
(74) *Attorney, Agent, or Firm*—Sughrue Mion, PLLC

(57) ABSTRACT

In a coaxial cable, a first insulating sheath covers an outer periphery of a first conductive wire. The first insulating sheath includes at least three insulating layers. A plurality of second conductive wires are spirally side-wound on an outer periphery of the first insulating sheath. The coaxial cable is wound around a core forming a closed magnetic path. Both ends of the first conductive wire serve as one of input terminals and output terminals of the transmission transformer, and both ends of the second conductive wires serve as the other one of the input terminals and the output terminals.

20 Claims, 5 Drawing Sheets

COAXIAL CABLE AND TRANSMISSION TRANSFORMER USING SAME

BACKGROUND OF THE INVENTION

This invention relates to a coaxial cable having excellent transmission characteristics for a high-frequency signal and high dielectric strength, and also relates to a transmission transformer using this coaxial cable.

A transmission transformer, used in the transmission of signals between medical equipments, is required to have high dielectric strength, and also is required to have enhanced transmission characteristics for high-frequency signals so as to meet the high-speed processing of signals by recent computers. These demands are not limited to medical equipments, but there are similar demands for other equipments. And besides, there is a demand for a compact and lightweight design of such a transformer.

As shown in FIG. 7, Japanese Utility Model Publication No. 63-140609U discloses a transmission transformer 101 for transmitting a signal, in which two conductive wires 104 and 105 are wound on a toroidal core 102. Each of the conductive wires 104 and 105, wound on the toroidal core 102 is a polyurethane-coated copper wire. Each of the conductive wires wound on the toroidal core of the transformer comprises a conductive single wire covered with an insulating layer.

On the other hand, as shown in FIG. 8, Japanese Patent Publication No. 6-203664A shows a coaxial cable for transmitting a high-frequency signal. In the coaxial cable, an insulative resin (polytetrafluoroethylene) 112 is coated on a center conductor 111 (composed of a silver-plated copper-sheathed steel wire), and a copper-deposited aluminum polyester tap 113 is wound on this resin coating layer 112. A plurality of tinned soft copper wires 114 are spirally side-wound on an outer periphery of the tape layer 113. The tinned soft copper wires are immersed in molten tin to form a tin coating 115. A protective layer 116 is formed so as to cover the tinned soft copper wires 114 coated with the tin coating 115.

International Standard for the Safety of Medical Electrical Equipment (IEC 60601-1) require that the insulation between a primary winding and a secondary winding of a transformer, used in a medical electrical equipment and required to have a reinforced insulation or a double insulation, should have the following construction so as to secure a required withstand voltage (dielectric strength).

(1) When one insulating layer is provided, its thickness must be not smaller than 1 mm.

(2) When two insulating layers are provided, the sum of their thicknesses must be not smaller than 0.3 mm.

(3) When three insulating layers are provided, a combination of any two of the three layers must pass a withstand voltage test for a reinforced insulation.

In the case of the transmission transformer disclosed in Japanese Utility Model Publication No. 63-140609U, each of the two conductive wires, wound on the toroidal core, comprises a single wire coated with a single insulating layer, and these conductive wires do not exhibit sufficient dielectric strength and high-frequency characteristics.

In the case of the coaxial cable disclosed in the Japanese Patent Publication No. 6-203664A, the center conductor is coated with a single insulative layer having a thickness which does not meet the requirements of the IEC 60601-1. Further, since the step of coating the molten tin is necessary, the manufacturing cost accordingly increases.

SUMMARY OF THE INVENTION

It is therefore an object of the invention to provide a coaxial cable having excellent transmission characteristics for a high-frequency signal and high dielectric strength, and also to provide a transmission transformer using such a coaxial cable.

In order to achieve the above object, according to the invention, there is provided a coaxial cable, comprising:

a first conductive wire;

a first insulating sheath, covering an outer periphery of the first conductive wire, the first insulating sheath including at least three insulating layers; and a plurality of second conductive wires, spirally side wound on an outer periphery of the first insulating sheath.

Preferably, the coaxial cable further comprises a second insulating sheath covering an outer periphery of each of the second conductive wires.

According to the invention, there is also provided a coaxial cable, comprising:

a first conductive wire;

a first insulating sheath, covering an outer periphery of the first conductive wire;

a plurality of second conductive wires, spirally side-wound on an outer periphery of the first insulating sheath; and a second insulating sheath, covering an outer periphery of each of the second conductive wires.

According to the invention, there is also provided a transmission transformer, comprising:

a core, forming a closed magnetic path; and a coaxial cable comprising:

a first conductive wire;

a first insulating sheath, covering an outer periphery of the first conductive wire, the first insulating sheath including at least three insulating layers; and a plurality of second conductive wires, spirally side-wound on an outer periphery of the first insulating sheath, wherein the coaxial cable is wound around the core such that both ends of the first conductive wire serve as one of input terminals and output terminals of the transmission transformer, and both ends of the second conductive wires serve as the other one of the input terminals and the output terminals. Preferably, the core is a toroidal core.

According to the invention, there is also provided a transmission transformer, comprising:

a core, forming a closed magnetic path; and a first coaxial cable and a second coaxial cable, each comprising:

a first conductive wire;

a first insulating sheath, covering an outer periphery of the first conductive wire, the first insulating sheath including at least three insulating layers; and a plurality of second conductive wires, spirally side-wound on an outer periphery of the first insulating sheath, wherein the first coaxial cable and the second coaxial cable are wound around the core such that:

a first end of the first conductive wire in the first coaxial cable and a first end of the first conductive wire in the second coaxial cable serve as one of input terminals and output terminals of the transmission transformer; and first ends of the second conductive wires in the first coaxial cable and first ends of the second conductive wires in the second coaxial cable serve as the other one of the input terminals and the output terminals.

Here, it is preferable that: a second end of the first conductive wire in the first coaxial cable and a second end of the first conductive wire in the second coaxial cable are electrically connected and grounded; and second ends of the second conductive wires in the first coaxial cable and second ends of the second conductive wires in the second coaxial cable are electrically connected and grounded.

It is also preferable that: the first coaxial cable and the second coaxial cable are wound around the core in a same direction; the first end of the first conductive wire in the first coaxial cable and the first end of the first conductive wire in the second coaxial cable are arranged in a same side relative to the core; and the first ends of the second conductive wires in the first coaxial cable and the first ends of the second conductive wires in the second coaxial cable are arranged in a same side relative to the core.

Alternatively, it is also preferable that: the first coaxial cable and the second coaxial cable are wound around the core in opposite directions; the first end of th first conductive wire in the first coaxial cable and the first end of the first conductive wire in the second coaxial cable are arranged in opposite sides relative to the core; and the first ends of the second conductive wires in the first coaxial cable and the first ends of the second conductive wires in the second coaxial cable are arranged in opposite sides relative to the core.

According to the invention, there is also provided a transmission transformer, comprising:

a core, forming a closed magnetic path; and a coaxial cable, comprising:

a first conductive wire;

a first insulating sheath, covering an outer periphery of the first conductive wire;

a plurality of second conductive wires, spirally side-wound on an outer periphery of the first insulating sheath; and a second insulating sheath, covering an outer periphery of each of the second conductive wires, wherein the coaxial cable is wound around the core such that both ends of the first conductive wire serve as one of input terminals and output terminals of the transmission transformer, and both ends of the second conductive wires serve as the other one of the input terminals and the output terminals.

Preferably, the core is a toroidal core.

According to the invention, there is also provided a transmission transformer, comprising:

a core, forming a closed magnetic path; and a first coaxial cable and a second coaxial cable, each comprising:

a first conductive wire;

a first insulating sheath, covering an outer periphery of the first conductive wire; and a plurality of second conductive wires, spirally side-wound on an outer periphery of the first insulating sheath, wherein the first coaxial cable and the second coaxial cable are wound around the core such that:

a first end of the first conductive wire in the first coaxial cable and a first end of the first conductive wire in the second coaxial cable serve as one of input terminals and output terminals of the transmission transformer; and first ends of the second conductive wires in the first coaxial cable and first ends of the second conductive wires in the second coaxial cable serve as the other one of the input terminals and the output terminals.

Here, it is preferable that a second end of the first conductive wire in the first coaxial cable and a second end of the first conductive wire in the second coaxial cable are electrically connected and grounded; and second ends of the second conductive wires in the first coaxial cable and second ends of the second conductive wires in the second coaxial cable are electrically connected and grounded.

It is also preferable that the first coaxial cable and the second coaxial cable are wound around the core in a same direction; the first end of the first conductive wire in the first coaxial cable and the first end of the first conductive wire in the second coaxial cable are arranged in a same side relative to the core; and the first ends of the second conductive wires in the first coaxial cable and the first ends of the second conductive wires in the second coaxial cable are arranged in a same side relative to the core.

Alternatively, it is also preferable that: the first coaxial cable and the second coaxial cable are wound around the core in opposite directions; the first end of the first conductive wire in the first coaxial cable and the first end of the first conductive wire in the second coaxial cable are arranged in opposite sides relative to the core; and the first ends of the second conductive wires in the first coaxial cable and the first ends of the second conductive wires in the second coaxial cable are arranged in opposite sides relative to the core.

According to the invention, there is also provided a transmission transformer, comprising:

a core, forming a closed magnetic path; and a first coaxial cable and a second coaxial cable, each comprising:

a first conductive wire; and a second conductive wire;

wherein the first coaxial cable and the second coaxial cable are wound around the core such that;

a first end of the first conductive wire in the first coaxial cable and a first end of the first conductive wire in the second coaxial cable serve as one of input terminals and output terminals of the transmission transformer; and a first end of the second conductive wire in the first coaxial cable and a first end of the second conductive wire in the second coaxial cable serve as the other one of the input terminals and the output terminals.

Here, it is preferable that: a second end of the first conductive wire in the first coaxial cable and a second end of the first conductive wire in the second coaxial cable are electrically connected and grounded; and a second end of the second conductive wire in the first coaxial cable and a second end of the second conductive wire in the second coaxial cable are electrically connected and grounded.

It is also preferable that: the first coaxial cable and the second coaxial cable are wound around the core in a same direction; the first end of the first conductive wire in the first coaxial cable and the first end of the first conductive wire in the second coaxial cable are arranged in a same side relative to the core; and the first end of the second conductive wire in the first coaxial cable and the first end of the second conductive wire in the second coaxial cable are arranged in a same side relative to the core.

Alternatively, it is also preferable that: the first coaxial cable and the second coaxial cable are wound around the core in opposite directions; the first end of the first conductive wire in the first coaxial cable and the first end of the first conductive wire in the second coaxial cable are arranged in opposite sides relative to the core; and the first end of the second conductive wire in the first coaxial cable and the first end of the second conductive wire in the second coaxial cable are arranged in opposite sides relative to the core.

It is also preferable that a winding direction of the first coaxial cable and the second coaxial cable is such a direction that a first magnetic flux generated in the core by a signal input to the first coaxial cable and a second magnetic flux generated in the core by a signal input to the second coaxial cable are oriented in a same direction.

It is also preferable that the core is a toroidal core.

In the coaxial cable of the present invention, since the first conductive wire is covered with the first insulating sheath including at least three insulating layers, the dielectric strength can be increased. In a case where each of the second conductive wires is covered with the second insulating sheath, a loss in the transmission of a high-frequency signal can be reduced.

The coaxial cable is wound on the core forming the closed magnetic path to constitute a transmission transformer in which the dielectric strength is increased, and a loss in the transmission of a high-frequency signal is reduced.

There can be provided a transmission transformer in which two coaxial cables are wound on the core forming the closed magnetic path, such that magnetic fluxes generated in the core by signals input to the coaxial cables are oriented in the same direction, thereby further reducing a loss in the high-frequency transmission.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Preferred embodiments of the invention will be described below in detail with reference to the accompanying drawings.

Figure 1:
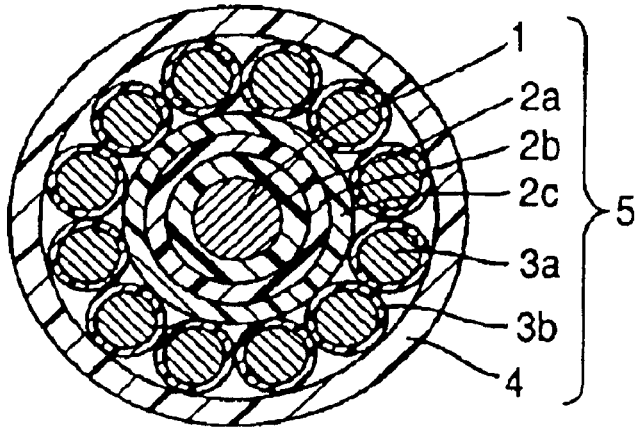
FIG. 1 is a view showing the structure of a coaxial cable according to a first embodiment of the invention.

FIG. 1 shows a coaxial cable 5 according to a first embodiment of the invention. In the coaxial cable 5, a center conductor 1 is covered or coated with three insulating layers 2*a*, 2*b* and 2*c*. Outer conductors 3*a*, each covered or coated with an insulating layer 3*b*, are spirally side-wound on an outer periphery of the insulating layer 2*c*. Further, the outer conductors 3*a* are collectively covered with a protective layer 4 made of an insulating material.

Preferably, the center conductor 1 is, for example, a tinned soft copper wire. Preferably, an outer diameter of the center conductor 1 is 0.20 mm to 1.20 mm.

Preferably, the insulating layers 2*a*, 2*b* and 2*c*, covering the center conductor 1, are made of an ETFE resin, a PPS film or an electrical polyester film. Preferably, the sum of thicknesses of the three insulating layers 2*a*, 2*b* and 2*c* is about 0.07 mm to about 0.15 mm.

Preferably, each of the outer conductors 3*a* is composed, for example, of a copper wire. Preferably, polyurethane is used as the insulating layer 3*b* covering the outer conductor 3*a*. Preferably, an outer diameter of the outer conductor 3*a*, coated with the polyurethane 3*a*, is about 0.017 mm. The center conductor 1 may be surrounded by about 30 outer conductors 3*a* each coated with the insulating layer. Preferably, the protective layer 4 may be formed with braided insulating fibers.

The number of the insulating layers is not limited to three, but may be more than three. The number of the outer conductors 3*a* may be so as to doubly surround the center conductor 1.

The center conductor 1, used in the coaxial cable 5, may be a single conductive wire, or may consist of a plurality of conductive wires.

Figure 2:
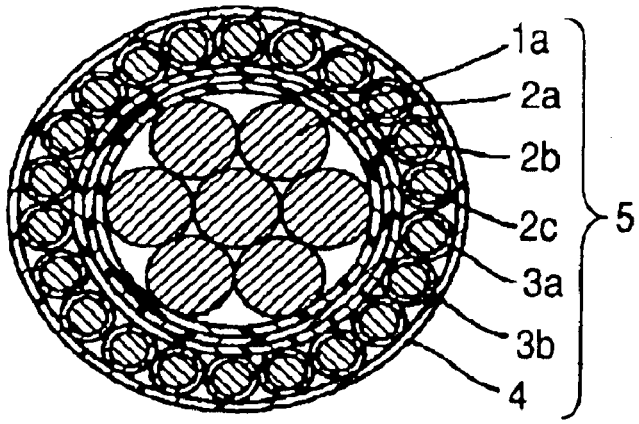
FIG. 2 is a view showing the structure of a coaxial cable according to a second embodiment of the invention.

As a second embodiment of the invention, the center conductor may be consisted of a plurality of insulation-coated single wires 1*a* twisted together to provide a concentric structure, as shown in FIG. 2. The center conductor may be a litz wire.

Figure 3:
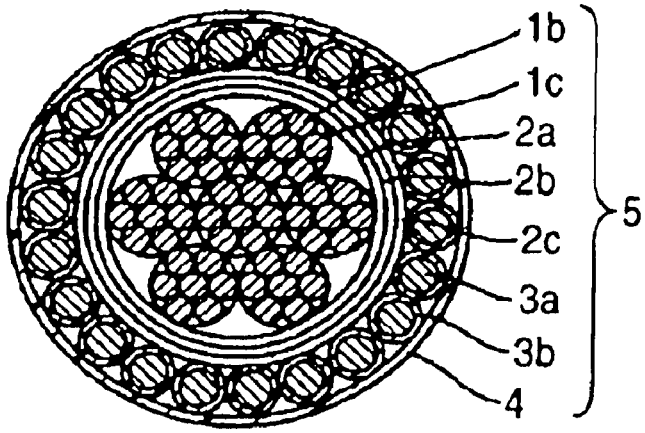
FIG. 3 is a view showing the structure of a coaxial cable according to a third embodiment of the invention.

As a third embodiment of the invention, the center conductor 1 may be a double-twisted complex litz wire consisting of a plurality of litz wires 1*c* twisted together, each litz wire 1*c* consisting of a plurality of insulation-coated single wires 1*b* twisted together as shown in FIG. 3.

Figure 4:
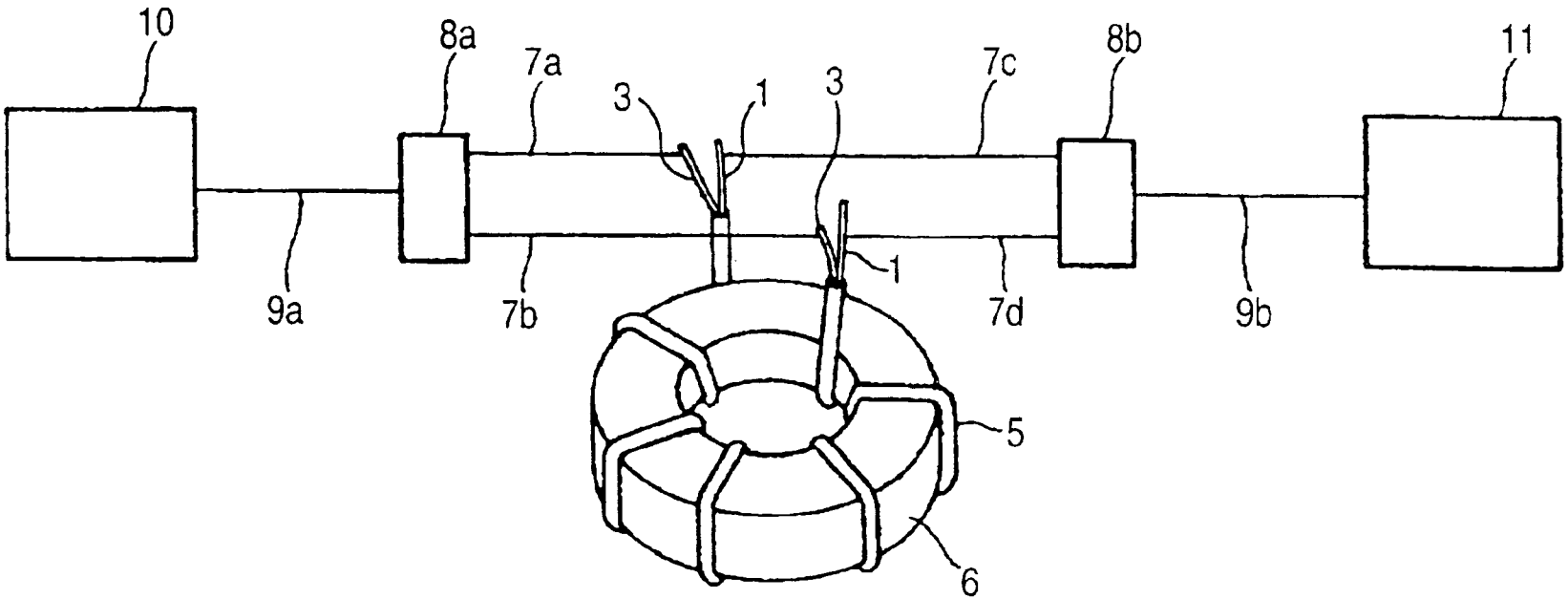
FIG. 4 is view showing the structure of a transmission transformer according to a fourth embodiment of the invention.

As a fourth embodiment of the invention, a transmission transformer employing a coaxial cable will be described with reference to FIG. 4. As the coaxial cable, the coaxial cable 5 according to any one of the above embodiments can be adopted.

The coaxial cable 5 is wound on a toroidal core 6 (which is a kind of closed magnetic path-core) in such a manner that turns of the wound coaxial cable 5 are generally equally spaced in a direction of the circumference of the toroidal core 6. Opposite ends of a center conductor 1, disposed respectively at opposite ends of the coaxial cable 5, are connected to a connector 8*b* via respective lead wires 7*c* and 7*d*. On the other hand, opposite ends of outer conductors 3, disposed respectively at the opposite ends of the coaxial cable 5, are connected to a connector 8*a* via respective lead wires 7*a* and 7*b*.

Thus, the opposite ends of the center conductor 1 and the opposite ends of the outer conductors 3 serve as input and output terminals for signal transmission purposes, and by doing so, the transmission transformer is formed.

For effecting a signal communication between an equipment 10 and an equipment 11, these equipments 10 and 11 are connected respectively to the connectors 8*a* and 8*b* via respective signal cables 9*a* and 9*b*. With this connection, a high-frequency signal transmission, having high dielectric strength, can be effected between the equipments 10 and 11.

Suitable examples of a material for the toroidal core 6 include ferrite, an amorphous material, a silicon steel sheet and Permalloy (registered Trademark of Western Electric Company).

Namely, by forming at least three insulating layers on the center conductor 1, a dielectric strength of 4 kV, required by the IEC 60601-1 for reinforced insulation, can be achieved. Further, by coating each of outer conductors 3*a* with an insulative material, a high-frequency loss can be reduced. Since the braided fibers are used to form a protective layer 4, the coaxial cable is excellent in flexibility and toughness. Since impedance characteristics of the coaxial cable can be made stable, it is possible to reduce the flux leakage and the capacitance deviation in a case where a coil is formed by such a coaxial cable. Therefore, impedance characteristics of the transmission transformer using such a coaxial cable can be also made stable. Incidentally, the impedance characteristics of the transmission transformer are such that the impedance of the transformer is matched to the impedance of the input-side signal cable.

Figure 5:
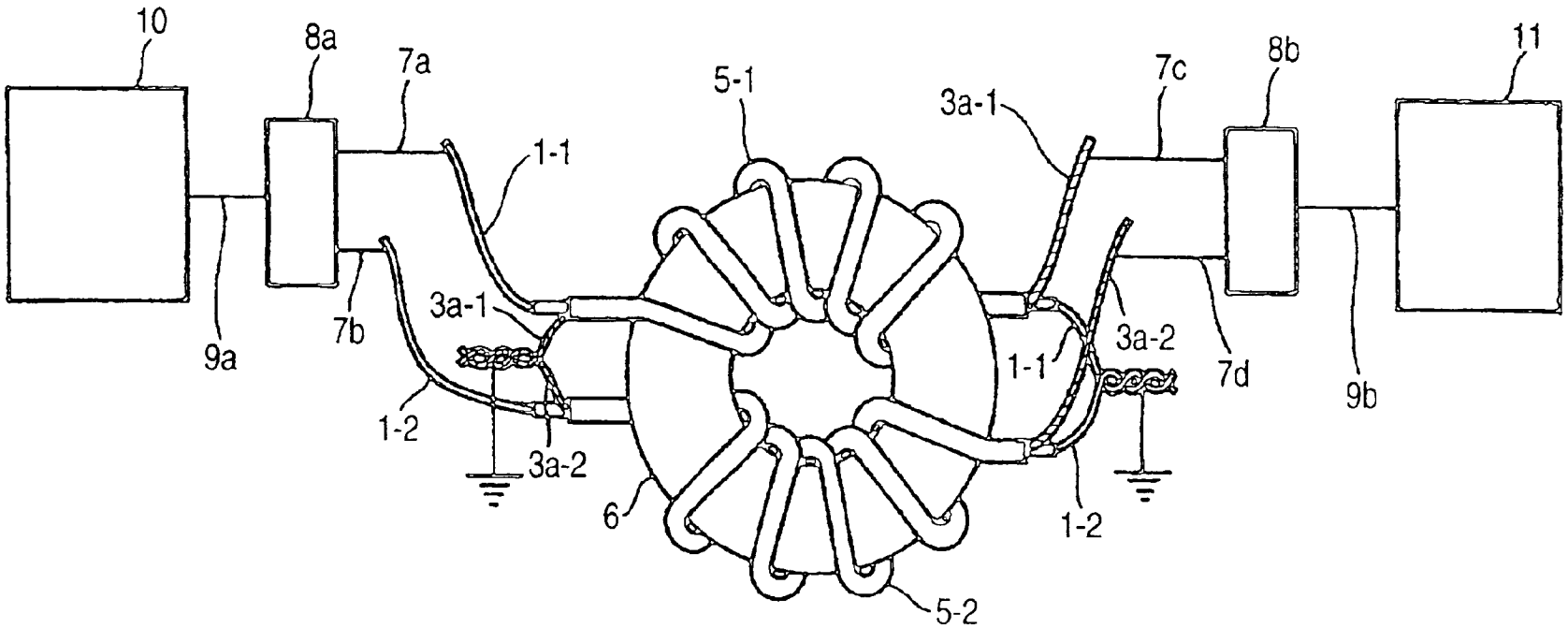
FIG. 5 is view showing the structure of a transmission transformer according to a fifth embodiment of the invention.

Next, a transmission transformer according to a fifth embodiment of the invention will be described with reference to FIG. 5.

Two coaxial cables 5-1 and 5-2 are wound on a toroidal core 6 in the same direction in such a manner that the number of turns of the coaxial cable 5-1 is equal to the number of turns of the coaxial cable 5-2. One end portions of the coaxial cables 5-1 and 5-2 (the left side in the figure), outer conductors 3*a*-1 of the coaxial cable 5-1 and outer conductors 3*a*-2 of the coaxial cable 5-2 are twisted together to be electrically connected together, and are connected to the ground. Center conductors 1-1 and 1-2 at the one end portions of the coaxial cables 5-1 and 5-2 are connected to a connector 8*a* via respective lead wires 7*a* and 7*b*.

At the other end portions of the coaxial cables 5-1 and 5-2 (the right side in the figure), the center conductors 1-1 and 1-2 are twisted together to be electrically connected together, and are connected to the ground. On the other hand, the outer conductors 3*a*-1 and the outer conductors 3*a*-2 at the other end portions of the coaxial cables 5-1 and 5-2 are connected to a connector 8*b* via respective lead wires 7*c* and 7*d*.

Thus, at the one end portions of the coaxial cables 5-1 and 5-2, the center conductors 1-1 and 1-2 serve as input and output terminals for signal transmission purposes, and at the other end portions of the coaxial cables 5-1 and 5-2, the outer conductors 3*a*-1 and the outer conductors 3*a*-2 serve as input and output terminals for signal transmission purposes. As a result, the transmission transformer is formed.

For effecting a signal communication between an equipment 10 and an equipment 11, these equipments 10 and 11 are connected respectively to the connectors 8*a* and 8*b* via respective signal cables 9*a* and 9*b*.

The impedance characteristics of the transmission transformer are such that the impedance of the transformer is matched to the impedance of the input-side signal cable.

With this connection, a loss in the transmission of a high-frequency signal is further reduced. This effect is such that a signal transmission on the order of several kHz to several 100 MHz can be effected.

Figure 6:
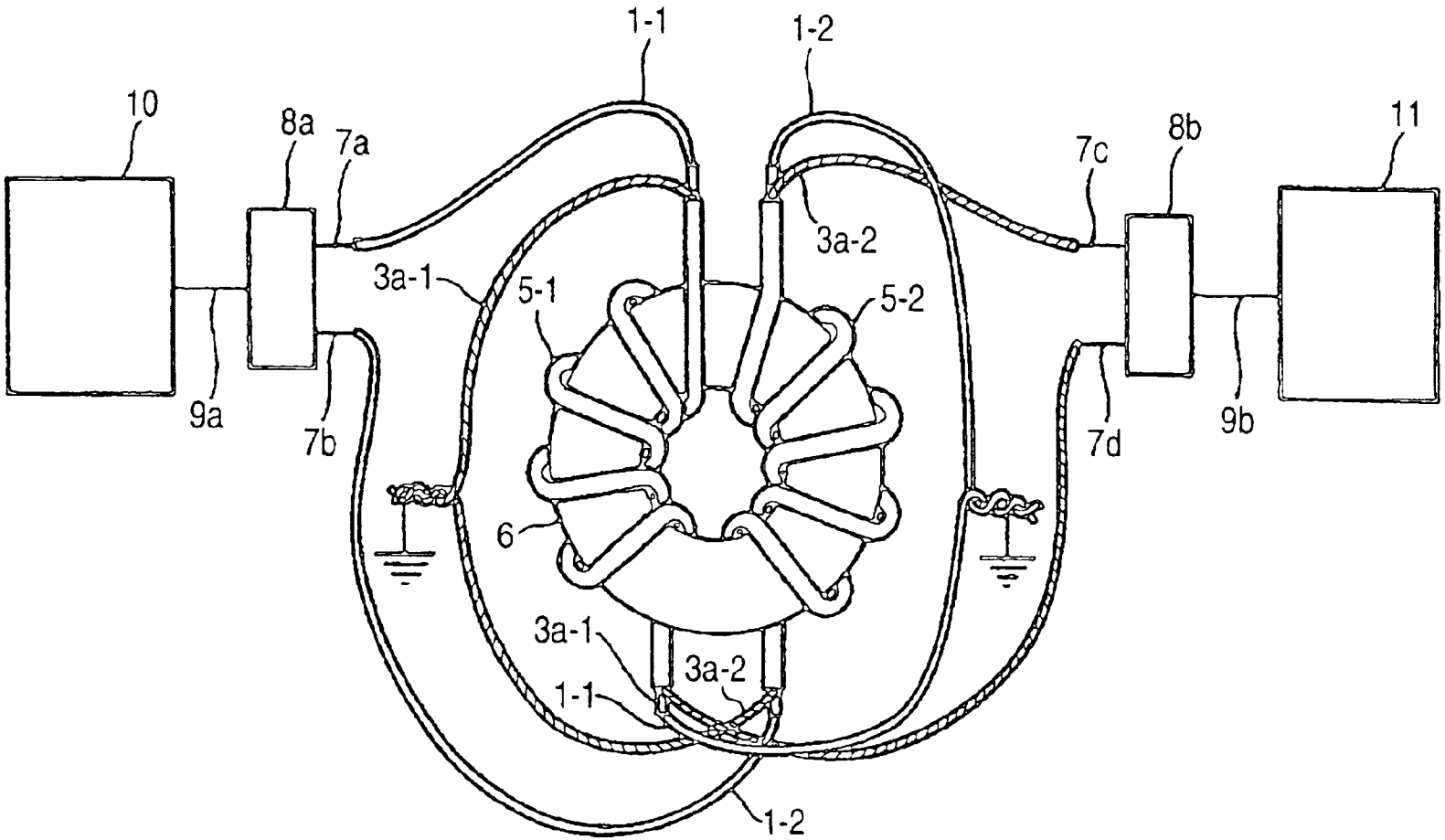
FIG. 6 is view showing the structure of a transmission transformer according to a sixth embodiment of the invention.
Figure 7:
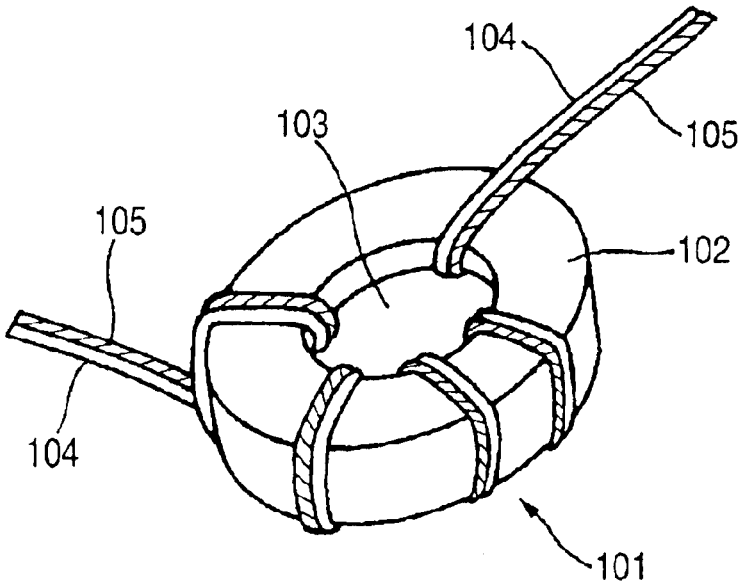
FIG. 7 PRIOR ART
FIG. 7 is a view showing a conventional transmission transformer.
Figure 8:
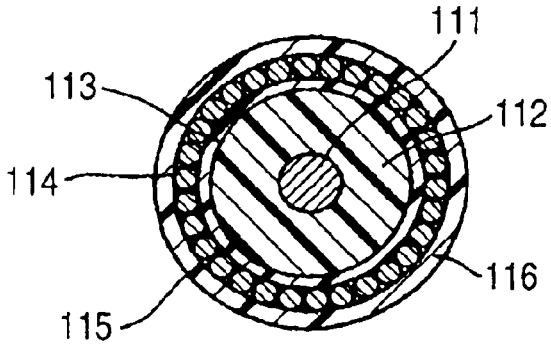
FIG. 8 PRIOR ART
FIG. 8 is a conventional coaxial cable for the transmission of a high-frequency signal.

Next, a transmission transformer according to a sixth embodiment of the invention will be described with reference to FIG. 6. This transmission transformer differs in the directions of winding of coaxial cables from the transmission transformer of the fifth embodiment.

Two coaxial cables 5-1 and 5-2 are wound on a toroidal core 6 in opposite directions in such a manner that the number of turns of the coaxial cable 5-1 is equal to the number of turns of the coaxial cable 5-2. Outer conductors 3*a*-1 at an upper end portion of the coaxial cable 5-1 and outer conductors 3*a*-2 at a lower end portion of the coaxial cable 5-2 are twisted together to be electrically connected together, and are connected to the ground. A center conductor 1-1 at the upper end portion of the coaxial cable 5-1 and a center conductor 1-2 at the lower end portion of the coaxial cable 5-2 are connected to a connector 8*a* via respective lead wires 7*a* and 7*b*.

The center conductor 1-1 at the lower end portion of the coaxial cable 5-1 and the center conductor 1-2 at the upper end portion of the coaxial cable 5-2 are twisted together to be electrically connected together, and are connected to the ground. The outer conductors 3*a*-1 at the lower end portion of the coaxial cable 5-1 and the outer conductors 3*a*-2 at the upper end portion of the coaxial cable 5-2 are connected to a connector 8*b* via lead wires 7*c* and 7*d*.

Thus, the connectors 8*a* and 8*b* serve to provide input and output terminals for signal transmission purposes.

For effecting a signal communication between an equipment 10 and an equipment 11, these equipments 10 and 11 are connected respectively to the connectors 8*a* and 8*b* via respective signal cables 9*a* and 9*b*.

The impedance characteristics of the transmission transformer are such that the impedance of the transformer is matched to the impedance of the input-side signal cable.

With this connection, as in the second embodiment, a loss in the transmission of a high-frequency signal is further reduced. This effect is such that a signal transmission on the order of several kHz to several 100 MHz can be effected.

In each of the fifth and sixth embodiments, the two coaxial-cables are wound in such directions that the magnetic flux, produced within the toroidal core by a signal transmitted from the input-side connector 8*a* to the two coaxial cables, flows in the same direction.

In each of the fifth and sixth embodiments, the coaxial cable according to any one of the first through third embodiments can be used. However, even in the case where the transmission transformers of the fifth and sixth embodiments do not use the above coaxial cable, the structure of each transmission transformer itself achieves the effect of reducing a loss in the high-frequency transmission.

In the fourth to sixth embodiments, preferably, there is provided a socket covering the transmission transformer over an area from the connector 8*a* to the connector 8*b*.

Examples of the equipments 10 and 11 include medical equipments and other equipments, and the transmission of signals can be effected between the two equipments 10 and 11.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A coaxial cable, comprising:

a first conductive wire;

a first insulating sheath, covering an outer periphery of the first conductive wire;

a plurality of second conductive wires, spirally side-wound on an outer periphery of the first insulating sheath; and a plurality of second insulating sheaths, respectively covering an outer periphery of each of the second conductive wires.

2. The coaxial cable as set forth in claim 1, wherein the first insulating sheath includes at least three insulating layers.

3. A transmission transformer, comprising:

a core, forming a closed magnetic path; and a coaxial cable, comprising:

a first conductive wire;

a first insulating sheath, covering an outer periphery of the first conductive wire, the first insulating sheath including at least three insulating layers; and a plurality of second conductive wires, spirally side-wound on an outer periphery of the first insulating sheath, wherein the coaxial cable is wound around the core such that both ends of the first conductive wire serve as a first terminal pair of the transmission transformer to be connected to a first component, and both ends of the second conductive wires serve as a second terminal pair of the transmission transformer to be connected to a second component.

4. The transmission transformer as set forth in claim 3, wherein the core is a toroidal core.

5. A transmission transformer, comprising:

a core, forming a closed magnetic path; and a first coaxial cable and a second coaxial cable, each comprising:

a first conductive wire;

a first insulating sheath, covering an outer periphery of the first conductive wire, the first insulating sheath including at least three insulating layers; and a plurality of second conductive wires, spirally side-wound on an outer periphery of the first insulating sheath, wherein the first coaxial cable and the second coaxial cable are wound around the core such that:

a first end of the first conductive wire in the first coaxial cable and a first end of the first conductive wire in the second coaxial cable exclusively serve as a first terminal pair of the transmission transformer to be connected to a first component; and first ends of the second conductive wires in the first coaxial cable and first ends of the second conductive wires in the second coaxial cable exclusively serve as a second terminal pair of the transmission transformer to be connected to a second component.

6. The transmission transformer as set forth in claim 5, wherein:

a second end of the first conductive wire in the first coaxial cable and a second end of the first conductive wire in the second coaxial cable are electrically connected and grounded; and second ends of the second conductive wires in the first coaxial cable and second ends of the second conductive wires in the second coaxial cable are electrically connected and grounded.

7. The transmission transformer as set forth in claim 5, wherein:

the first coaxial cable and the second coaxial cable are wound around the core in a same direction;

the first end of the first conductive wire in the first coaxial cable and the first end of the first conductive wire in the second coaxial cable are arranged in a same side relative to the core; and the first ends of the second conductive wires in the first coaxial cable and the first ends of the second conductive wires in the second coaxial cable are arranged in a same side relative to the core.

8. The transmission transformer as set forth in claim 5, wherein:

the first coaxial cable and the second coaxial cable are wound around the core in opposite directions;

the first end of the first conductive wire in the first coaxial cable and the first end of the first conductive wire in the second coaxial cable are arranged in opposite sides relative to the core; and the first ends of the second conductive wires in the first coaxial cable and the first ends of the second conductive wires in the second coaxial cable are arranged in opposite sides relative to the core.

9. A transmission transformer, comprising:

a core, forming a closed magnetic path; and a coaxial cable, comprising:

a first conductive wire;

a first insulating sheath, covering an outer periphery of the first conductive wire;

a plurality of second conductive wires, spirally side-wound on an outer periphery of the first insulating sheath; and a second insulating sheath, covering an outer periphery of each of the second conductive wires, wherein the coaxial cable is wound around the core such that both ends of the first conductive wire serve as a first terminal pair of the transmission transformer to be connected to a first component, and both ends of the second conductive wires serve as a second terminal pair of the transmission transformer to be connected to a second component.

10. The transmission transformer as set forth in claim 9, wherein the core is a toroidal core.

11. A transmission transformer, comprising:

a core, forming a closed magnetic path; and a first coaxial cable and a second coaxial cable, each comprising:

a first conductive wire;

a first insulating sheath, covering an outer periphery of the first conductive wire; and a plurality of second conductive wires, spirally side-wound on an outer periphery of the first insulating sheath, wherein the first coaxial cable and the second coaxial cable are wound around the core such that:

a first end of the first conductive wire in the first coaxial cable and a first end of the first conductive wire in the second coaxial cable exclusively serve as a first terminal pair of the transmission transformer to be connected to a first component; and first ends of the second conductive wires in the first coaxial cable and first ends of the second conductive wires in the second coaxial cable exclusively serve as a second terminal pair of the transmission transformer to be connected to a second component.

12. The transmission transformer as set forth in claim 11, wherein:

a second end of the first conductive wire in the first coaxial cable and a second end of the first conductive wire in the second coaxial cable are electrically connected and grounded; and second ends of the second conductive wires in the first coaxial cable and second ends of the second conductive wires in the second coaxial cable are electrically connected and grounded.

13. The transmission transformer as set forth in claim 11, wherein:

the first coaxial cable and the second coaxial cable are wound around the core in a same direction;

the first end of the first conductive wire in the first coaxial cable and the first end of the first conductive wire in the second coaxial cable are arranged in a same side relative to the core; and the first ends of the second conductive wires in the first coaxial cable and the first ends of the second conductive wires in the second coaxial cable are arranged in a same side relative to the core.

14. The transmission transformer as set forth in claim 11, wherein:

the first coaxial cable and the second coaxial cable are wound around the core in opposite directions;

the first end of the first conductive wire in the first coaxial cable and the first end of the first conductive wire in the second coaxial cable are arranged in opposite sides relative to the core; and the first ends of the second conductive wires in the first coaxial cable and the first ends of the second conductive wires in the second coaxial cable are arranged in opposite sides relative to the core.

15. A transmission transformer, comprising:

a core, forming a closed magnetic path; and a first coaxial cable and a second coaxial cable, each comprising:

a first conductive wire; and a second conductive wire;

wherein the first coaxial cable and the second coaxial cable are wound around the core such that:

a first end of the first conductive wire in the first coaxial cable and a first end of the first conductive wire in the second coaxial cable exclusively serve as a first terminal pair of the transmission transformer to be connected to a first component; and a first end of the second conductive wire in the first coaxial cable and a first end of the second conductive wire in the second coaxial cable exclusively serve as a second terminal pair of the transmission transformer to be connected to a second component.

16. The transmission transformer as set forth in claim 15, wherein:

a second end of the first conductive wire in the first coaxial cable and a second end of the first conductive wire in the second coaxial cable are electrically connected and grounded; and a second end of the second conductive wire in the first coaxial cable and a second end of the second conductive wire in the second coaxial cable are electrically connected and grounded.

17. The transmission transformer as set forth in claim 15, wherein:

the first coaxial cable and the second coaxial cable are wound around the core in a same direction;

the first end of the first conductive wire in the first coaxial cable and the first end of the first conductive wire in the second coaxial cable are arranged in a same side relative to the core; and the first end of the second conductive wire in the first coaxial cable and the first end of the second conductive wire in the second coaxial cable are arranged in a same side relative to the core.

18. The transmission transformer as set forth in claim 15, wherein:

the first coaxial cable and the second coaxial cable are wound around the core in opposite directions;

the first end of the first conductive wire in the first coaxial cable and the first end of the first conductive wire in the second coaxial cable are arranged in opposite sides relative to the core; and the first end of the second conductive wire in the first coaxial cable and the first end of the second conductive wire in the second coaxial cable are arranged in opposite sides relative to the core.

19. The transmission transformer as set forth in claim 15, wherein a winding direction of the first coaxial cable and the second coaxial cable is such a direction that a first magnetic flux generated in the core by a signal input to the first coaxial cable and a second magnetic flux generated in the core by a signal input to the second coaxial cable are oriented in a same direction.

20. The transmission transformer as set forth in claim 15, wherein the core is a toroidal core.

* * * * *